US005295863A

United States Patent [19]

Cady

[11] Patent Number: 5,295,863

[45] Date of Patent: Mar. 22, 1994

[54] ELECTRICAL CONNECTOR FOR COAXIAL CABLE

[75] Inventor: James W. Cady, Austin, Tex.

[73] Assignee: Arrowsmith Shelburne, Inc., Shelburne, Vt.

[21] Appl. No.: 946,747

[22] Filed: Sep. 17, 1992

[51] Int. Cl.[5] ..... H01R 9/07

[52] U.S. Cl. ..... 439/578; 439/751; 439/579

[58] Field of Search ..... 439/578–585, 439/675, 607, 609, 610, 101, 108, 98, 99, 751

[56] References Cited

U.S. PATENT DOCUMENTS

| | | | |
|---|---|---|---|
| 3,406,373 | 10/1968 | Forney, Jr. | 439/675 |
| 3,573,704 | 4/1971 | Tarver | 339/14 |
| 4,365,856 | 12/1982 | Yaegashi | 339/14 R |
| 4,596,432 | 6/1986 | Tighe | 339/107 |
| 4,598,969 | 7/1986 | Stephenson | 439/608 |
| 4,628,150 | 12/1986 | Luc | 174/88 C |
| 4,655,515 | 4/1987 | Hamsher et al. | 339/14 R |
| 4,737,117 | 4/1988 | Lockard | 439/92 |
| 4,867,707 | 9/1989 | Widdoes | 439/675 |
| 4,897,046 | 1/1990 | Tengler et al. | 439/579 |

*Primary Examiner*—David L. Pirlot
*Attorney, Agent, or Firm*—Pretty, Schroeder, Brueggemann & Clark

[57] ABSTRACT

An inexpensive, easily assembled electrical connector provides simultaneous secure connection of both center and outer conductors in a bundle of coaxial wires and includes a conductive housing having a cylindrical bore for each wire of the bundled cable. Each bore has a small diameter constriction adjacent a rear surface of the housing and a dielectric insert is disposed in each cylindrical bore from the constriction forward to a front surface of the housing. A conductive pin is attached to the end of each coaxial wire and is inserted into one of the inserts, carrying the coaxial cable into the rear end of a housing bore until the outer conductor meets the constriction, electrically coupling all of the outer conductors to the conductive housing and precisely positioning each of the center conductors relative to a mating center conductor. A connector assembly has a pair of mating connectors that may be electrically connected.

3 Claims, 4 Drawing Sheets

ELECTRICAL CONNECTOR FOR COAXIAL CABLE

BACKGROUND OF THE INVENTION

This invention relates generally to electrical connectors for connecting coaxial cables and, more particularly, electrical connectors that removably interconnect multi-wire cables.

As electronic products have grown in complexity, it has become necessary to removably connect an increasing number of wires between products and between components within those products. One way of organizing multiwire connections has been to gather the wires into cables. Such cables can gather the wires into either a cylindrical cross-section or a flat ribbon that contains one or more planes or layers of multiple wires extending in a parallel relationship. One such arrangement is described in U.S. Pat. No. 5,084,594 to Cady et al.

As the complexity and density of the wires within cables have increased, the problems associated with removably connecting all of the wires in an easy-to-use, low-cost, and yet reliable manner have increased. The integrity of the electrical connections and insulations must be maintained, which means that the connector must offer secure and positive mating engagement despite small clearances between wires. In addition, the connection cannot be a source of electromagnetic interference or other discontinuity for the signals passing through the wires, and the forces required to connect and disconnect the wires cannot be excessive.

For many modern devices, the cables are comprised of coaxial wires, each wire having an inner or center conductor concentrically surrounded by an insulating sheath and then by an outer conductor, or conductive shield. Often, the coaxial wires are covered with an insulating layer before they are gathered into a cable. Coaxial wires increase interconnection problems because both the center conductor and the outer conductive shield must be terminated. Furthermore, coaxial wires are often used in high-frequency signal applications in which it is important for the electrical connector between two wires being connected to provide the same characteristic impedance as the wires. Electrical signals passing through a coaxial wire develop an electrical field between the center and outer conductors and any loss in continuity of the electrical field results in deterioration of the signal quality. Therefore, it is also important to provide a minimum electrical discontinuity for signals passing along one coaxial wire through the connector to a connected coaxial cable. The continuity must be maintained for all wires in the cable.

Multiple-wire connectors have been developed with reasonably good connection and disconnection forces and with reasonably good electrical connection between conductors. Such connectors, however, tend to be fairly expensive to manufacture and can be difficult to connect to coaxial-wire cables. They also tend to cause undesirably large discontinuities in the electric fields of high frequency signals passing through the cables.

U.S. Pat. No. 3,573,704 to Tarver describes a cable connector that connects a flat ribbon coaxial cable and a round multi-wire coaxial cable. An adapter connected to the flat cable and another adapter connected to the round coaxial cable are connected to a connector block that maintains an impedance match between the two adapters. A non-conductive mounting bar is mated to a conducting block to obtain a sufficient number of contacts with the conductors of the flat cable.

U.S. Pat. No. 4,365,856 to Yaegashi et al. describes an electrical connector for flat ribbon coaxial cables that uses a signal contact coupled to the end of each center conductor and a ground contact coupled to the outer conductive shield of each coaxial wire. One end of the flat ribbon cable is wrapped around a guide block to properly hold the stripped wire ends. The center conductors are then attached to the signal contacts and the outer conductive shields are attached to the ground contact. The signal contacts and the ground contact are attached to the guide block, which is then inserted into a housing to provide simultaneous termination.

U.S. Pat. No. 4,596,432 to Tighe describes a flat ribbon coaxial cable termination connector in which the conductors of a coaxial cable are connected to a housing that is held within a clamp body.

U.S. Pat. No. 4,628,150 to Luc describes a method of joining the outer conductors of coaxial wires by welding a bridging strap between them.

Various arrangements of double-row electrical connectors for multiple-lead ribbon cables are described in U.S. Pat. No. 4,655,515 to Hamsher et al. and U.S. Pat. No. 4,737,117 to Lockard.

Notwithstanding these developments in the area of electrical connectors, there remains a need for a low cost, reliable, easy-to-use cable connector that provides minimum disruption of the electrical fields attendant to high frequency signals passing through the cable. The present invention satisfies this need.

SUMMARY OF THE INVENTION

The present invention is embodied in an electrical connector that provides secure attachment and interconnection of cables having multiple coaxial wires by simultaneously establishing both a common electrical connection for the outer conductive shield of all the wires in such cables and a low-noise, secure connection between the center conductors of the wires. The electrical connector includes a housing with a cylindrical bore extending through the housing for each wire. When the center conductor of each wire is coupled to a conventional conductive pin that is then inserted into one of the bores, the outer conductive shield of each wire is coupled with the housing and with the outer conductive shields of all the other wires in the cable. In a preferred arrangement of the invention, the housing is constructed from a conductive material and the inside diameter of each cylindrical bore includes an insulating dielectric layer extending through the bore to insulate each wire's center conductor from the housing.

An electrical connector in accordance with the present invention comprises an engagement housing, or male connector, and a receiving housing, or female connector. The center conductors of each coaxial wire in a first cable are coupled to conductive pins, which are inserted into the cylindrical bores of the engagement housing, and the center conductors of each coaxial wire in a second cable are coupled to conductive pins, which are then inserted into the cylindrical bores of the receiving housing. The electrical connector is then assembled by inserting the engagement housing into the receiving housing, which simultaneously and securely electrically couples the outer conductive shields of the first cable to the outer conductive shields of the second cable and also electrically couples the center conductors of the first cable to corresponding center conductors of the second cable. Thus, coupling the two connector housings together provides a low-noise, high-quality termination between all the outer conductive shields of both cables and provides precise placement and coupling of the respective center conductors of both cables.

Each conductive pin preferably includes a solder or crimp receiving tab at its rear end that receives the center conductor of each coaxial wire. The front end of each pin is electrically contiguous with the receiving tab and therefore is electrically coupled to the center conductor. When a conductive pin is inserted into the rear of one of the housing's cylindrical bores, the coaxial wire is carried into the bore until the outer conductor meets the housing and electrically couples the wire's outer conductor with the common conductive surface of the housing. Meanwhile, the pin's front end is positioned in the center of the bore, electrically insulated from the housing by the insulating dielectric layer. Each housing can advantageously be constructed from a conductive material throughout, inherently coupling the outer conductors within each cylindrical bore to one another, or the inner surfaces of the bores can be made conductive and electrically interconnected.

The insulating dielectric layer within each cylindrical bore is preferably an insulating material with a thickness and dielectric constant selected to cause the characteristic impedance of the connector to match the characteristic impedance of the coaxial wire. This minimizes any electrical field discontinuity for a signal passing through the wire, through the connector, and to another connected coaxial wire, and helps preserve the signal quality of the signal passing through the wires and the connector. In addition, the insulating dielectric layers in the bores of the probe housing preferably fit around and receive the ends of the insulating dielectric layers in the bores of the receiving housing, thereby providing a secure coupling and continuity between the dielectric layers.

The conductive pins at the end of each coaxial wire can be conventional pins having a solder or crimp tab at the rear end and a conductive smaller diameter front end. The conductive pins associated with the engagement housing preferably have a small diameter solid probe at the front end and the pins associated with the receiving housing preferably have a small diameter, hollow probe at the front end that receives the solid probe pins. Each cylindrical bore can be provided with an internal rim that fits against a circumferential rim of each conductive pin, holding the conductive pin in the bore against vibration and light forces, but allowing the pin and associated coaxial wire to be removed with a deliberate disconnecting force. Using conventional conductive pins reduces the cost of using the novel wire connector of the present invention and makes it possible to achieve the benefits of the invention without expensive cable retrofit programs.

Thus, the electrical connector in accordance with the present invention preferably includes three interlocking elements. First, the conductive pins on the end of each coaxial wire in the cables interlock to make a precise, secure connection between the center conductors. Next, the dielectric layers within the cylindrical bores of each housing interlock to reduce any electrical field discontinuity for signals passing through the wires. Lastly, the engagement and receiving housings interlock to provide a low-noise, secure termination for the outer conductors of each wire.

BRIEF DESCRIPTION OF THE DRAWINGS

A better understanding of the invention may be had from a consideration of the following detailed description, taken in conjunction with the accompanying drawings, in which.

DESCRIPTION OF THE PREFERRED EMBODIMENT

Figure 1:
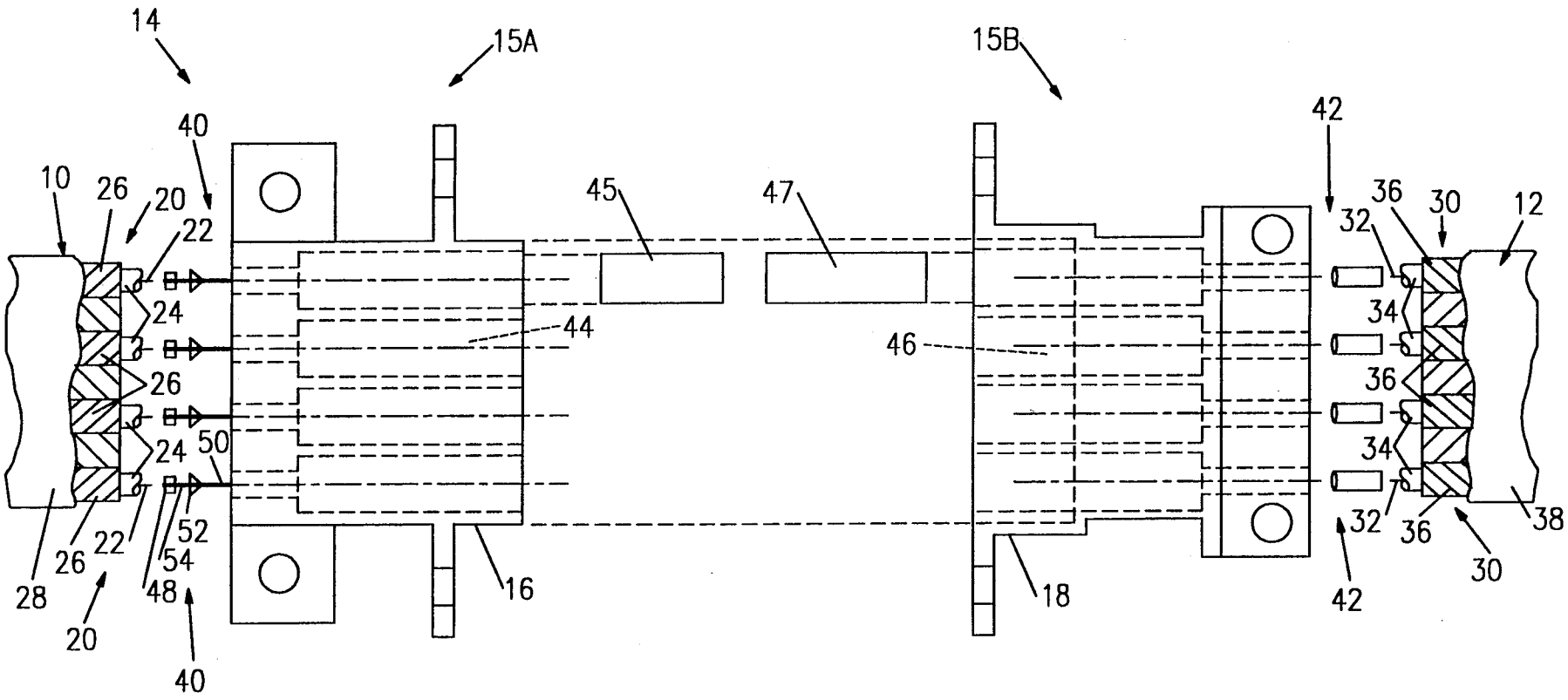
FIG. 1 is an exploded plan view of a first multi-wire flat ribbon coaxial cable connector.

Referring now to FIG. 1, a first flat ribbon, multi-wire coaxial cable 10 is to be connected to a second flat ribbon, multi-wire coaxial cable 12 by a connector assembly 14 constructed in accordance with the present invention. Connector assembly 14, having mating connectors 15A, 15B, simultaneously provides a low-noise, common termination for all of the outer conductors of the flat ribbon cables and precisely positions each of the center conductors of the first cable with respect to corresponding center conductors of the second cable. The first and second cables 10, 12 are connected together by initially coupling the first cable 10 to a conductive male housing 16 and coupling the second cable 12 to a conductive female housing 18, and then connecting the two housings together. The housings are constructed from a conductive material. Coupling each cable to its respective housing simultaneously connects all of that cable's outer conductors to the housing and securely positions all of that cable's center conductors relative to the center conductors of the other cable.

Both coaxial cables 10 and 12 are constructed identically and, more specifically, the first flat ribbon cable 10 is made up of a plurality of coaxial wires 20 each having a center conductor 22 surrounded by an insulating sheath 24, which in turn is surrounded by an outer conductor 26. As is conventional practice, the coaxial wires 20 can be covered by a protective outer insulating layer 28. Likewise, the second flat ribbon cable 12 is made up of a plurality of coaxial wires 30 each having a center conductor 32 surrounded by an insulating sheath 34, each of which is surrounded by an outer conductor 36, and then collectively covered by a protective outer insulating layer 38.

Coupling the flat ribbon cables 10 and 12 to their respective housings 16 and 18 involves attaching the coaxial wires 20 and 30 of each cable to conductive pins 40 and 42, respectively, that are inserted into the housings and that are then coupled together. In particular, the center conductor 22, 32 of each coaxial wire is attached to a conductive pin 40, 42 and a length of the outer conductor 26, 36 and insulating sheath 24, 34 is exposed. The center conductors 22 that are to be connected to the male housing 16 are attached to male conductive pins 40 and the center conductors 32 that are to be connected to the female housing 18 are attached to female conductive pins 42. Each housing 16 and 18 is provided with a plurality of cylindrical bores 44 and 46, respectively. A male insulating dielectric insert 45 is first inserted into each male housing bore, and a female insulating dielectric insert 47 is first inserted into each female housing bore.

When each conductive pin 40 and 42 is inserted into one of the cylindrical bores 44 and 46, the outer conductor 26 and 36 of each respective coaxial wire 20 and 30 is simultaneously coupled electrically to the outer conductors of all the other coaxial wires in the flat ribbon cable 10 and 12, via the conductive housing 16, 18, providing a low-noise, high-quality electrical connection for all of the outer conductors. At the same time, the center conductor of each coaxial wire is securely located within the cylindrical bore, providing a precise position for each center conductor relative to the corresponding center conductor of the other cable.

Figure 2:
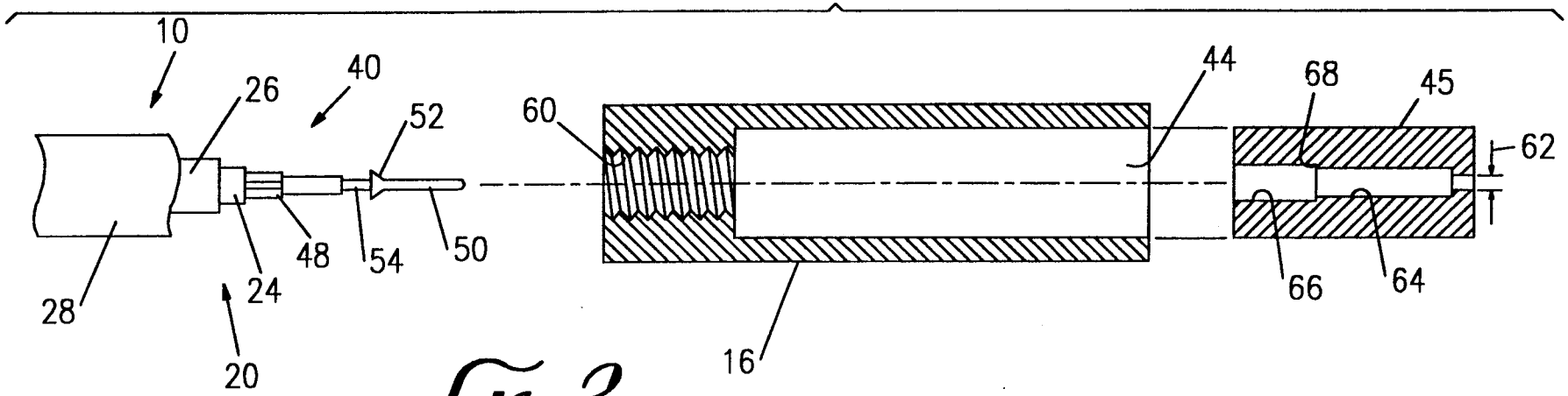
FIG. 2 is an exploded cross-sectional view of the male connector housing shown in FIG. 1 and the male insulating dielectric layer to be placed within a cylindrical bore of the male connector housing.

The coupling of the first cable 10 to the male connector housing 16 is shown in greater detail in FIG. 2, to which reference is now made. The male-type conductive pins 40 are of conventional design, and include a rear end with a solder or crimp receiving tab 48 and a front end with a small diameter solid probe 50. Such conductive pins have been known to provide reasonably good connect and disconnect forces when used with conventional electrical connectors. The center conductor 22 of each coaxial wire 20 is exposed and is then electrically coupled to the receiving tab 48 of the conductive pin by being crimped or soldered to the tab (see FIG. 1). Each conductive pin has a flared portion 52 forward of the crimp tab and a reduced diameter portion 54 located between the two for providing a friction fit into a corresponding bore 44 of the male housing 16, as described in more detail below.

Each cylindrical bore 44 of the male housing 16 advantageously includes a secure means for providing a reliable electrical connection and reasonable connect and disconnect forces. Each cylindrical bore includes threads 60 that help to keep the outer conductor 26 engaged in the bore by pressing against the outer conductor and providing a friction fit.

As noted, the inner surface of the cylindrical bores 44 forward of the threads 60 are provided with a dielectric insert 45. Preferably, the dielectric insert 45 has an outside diameter sufficiently small to fit within the bore 44, but sufficiently large to provide a snug friction fit. The dielectric material shields the portion of the conductive pin 40 rearward of flare 52 from making contact with the cylindrical bore 44 of the male conductive housing 16 and has a thickness and dielectric constant selected to produce a characteristic impedance that matches the characteristic impedance of the insulating sheath 24. This provides improved continuity for signals passing back and forth through the first cable 10, through the electrical connector 16, and into the second cable 12, minimizing any deterioration in signal quality.

The dielectric insulating material 45 is generally cylindrical and has a segmented central bore with graduated diameters. The central bore 62 with the smallest diameter is sized sufficiently large to allow the probe end 50 to pass through. The next largest bore 64 has a diameter sized sufficiently large for the flare 52, crimp tab 48 and reduced diameter portion 54 of the pin 40 to pass through. Finally, the largest diameter bore 66 is sized sufficiently large for the insulating sheath 24 to pass through. A shoulder 68 at the forward end of the largest bore 66 effectively stops the stripped wire 20 from advancing too far into the cylindrical bore 44 of the dielectric material 45 when the pin 40 is inserted.

Figure 3:
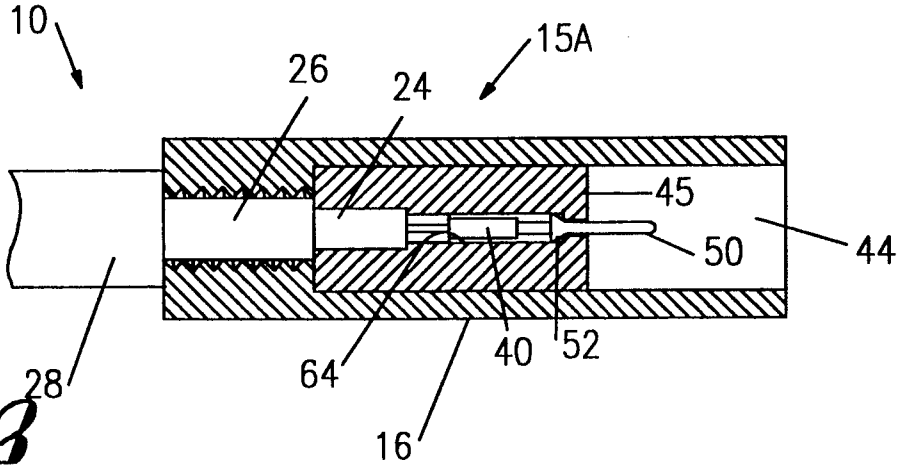
FIG. 3 is a cross-sectional view of the male connector housing shown in FIG. 2 with the elements assembled together to show the male insulating dielectric layer and male conductive pin in place within the male housing.

The first cable 10 is shown in FIG. 3 after it has been coupled to the male housing 16 of connector 15A. The insulating dielectric layer 45 has been inserted into the male housing through the front end of the bore 44. The coaxial wire 20 has been coupled to the conductive pin 40 and has been inserted into the housing through the rear end of the bore. As a result, the outer conductor 26 makes contact with the conductive housing 16, the conductive pin 40 is shielded from contact with the housing by the insulating cylindrical insert 45, and the probe 50 of the conductive pin projects outwardly from the dielectric but still within the cylindrical bore 44. The flare 52 engages the wall of the cylindrical central bore 64 within insulating layer 45 and resists removal of pin 40 from the insulating layer 45.

Figure 4:
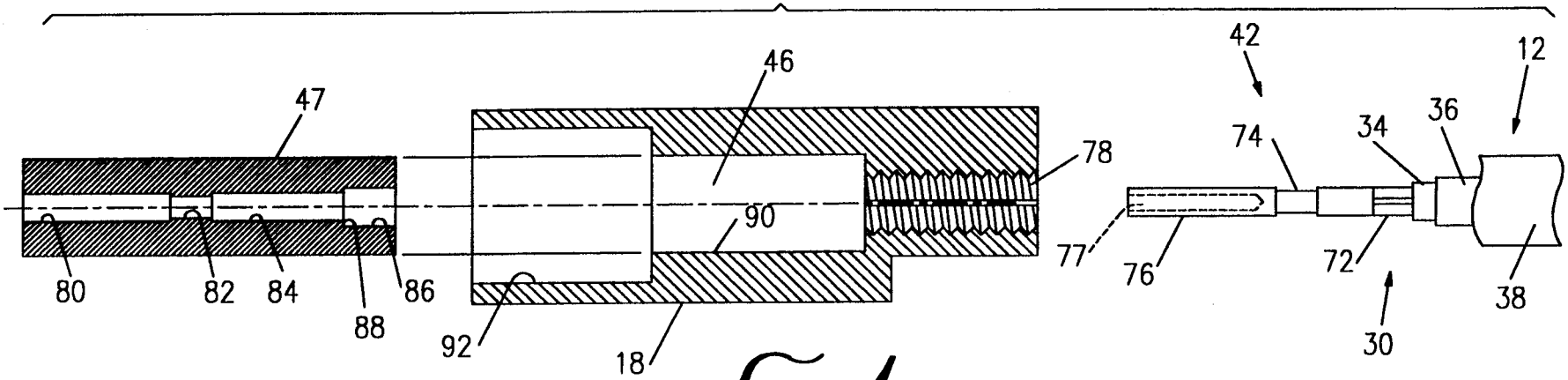
FIG. 4 is an exploded cross-sectional view of the female connector housing shown in FIG. 1 and the female insulating dielectric layer to be placed within a cylindrical bore of the female connector housing.

The other part of the electrical connector 14 in accordance with the present invention is for use with female-type conductive pins. FIG. 4 is an exploded cross-sectional view of the second cable 12 being coupled to the female connector housing 18 of connector 15B. One end of the coaxial wire 30 has been coupled to a female conductive pin 42. The female conductive pin 42 can be of a conventional design, in which the conductive pin includes a rear end with a tab 72 that receives the exposed end of the cable's center conductor 32 (see FIG. 1). The female pin includes a constricted center section 74 and a front end with a hollow probe 76 having a central axial bore 77 sized to receive the solid probe 50 of the male conductive pin 40 that is illustrated in FIGS. 1 and 2. In this way, the center conductors of the two coaxial cables 10 and 12 can be coupled together to provide an uninterrupted electrical path for signals.

The cylindrical bores 46 of the female housing 18 advantageously include a secure means for providing a reliable electrical connection and reasonable connect and disconnect forces. Each cylindrical bore includes threads 78 that help to keep the outer conductor 36 engaged in the bore by pressing against the outer conductor and providing a friction fit.

The inner surface of the cylindrical bore 46 forward of the threads 78 is provided with an insulating dielectric material insert 47. The dielectric material shields the front end 76 of the conductive pin 42 from making contact with the cylindrical bore 46 of the conductive female housing 18 and preferably extends the length of the bore with a thickness and dielectric to match the characteristic impedance of a similar length of the insulating sheath 34. This provides improved continuity for a signal passing through the second cable 12, through the electrical connector 18, and into the first cable 10, minimizing any deterioration in signal quality.

The insulating dielectric material insert 47 is generally cylindrical, and has a segmented central bore that has graduated diameters. The diameter of a section 80 of the central bore at the forward end is sufficiently large to allow the forward end 76 of the female conductive pin 42 to pass through and be matingly received by the portion 80. The insulating dielectric material includes an intermediate bore section 82 having a diameter that is sized to mate with the reduced diameter constriction 74 in the female conductive pin 42. Just to the rear of the central constriction is a bore section 84 having a diameter that is sufficiently large to allow the conductive pin 42 to pass through but small enough to prevent the passage of the insulating sheath 34 of the coaxial wire 30. An end section 86 of the dielectric material 47 has an enlarged diameter that is sufficiently large to accept the outer conductor 36. A shoulder 88 in the dielectric cylinder 47 effectively operates as an axial stop for the outer conductor 36.

The cylindrical bore 46 of the female housing 18 includes graduated segments having a segment 90 with a diameter sufficiently large to allow the insulating dielectric insert 47 to pass through and includes a second, enlarged section 92 at the forward end. The length of the segment 90 is less than the total length of the dielectric cylinder 47 to allow the forward end of the cylinder 47 to project into the enlarged diameter section 92 of the housing bore. This configuration is used to securely engage the male housing 16 with the female housing 18, as described further below.

Figure 5:
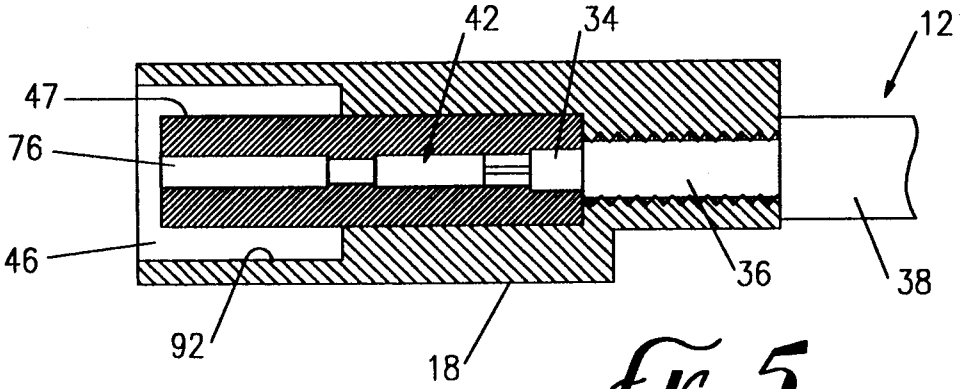
FIG. 5 is a cross-sectional view of the female connector housing shown in FIG. 2 with the elements assembled together to show the female insulating dielectric layer and female conductive pin in place within the female housing.

The second cable 12 is shown in FIG. 5 after it has been coupled to the female housing 18. The insulating dielectric material 47 has been inserted into the female housing through the front end of the bore 46. The coaxial wire 30 has been coupled to the conductive pin 42 and has been inserted into the housing through the rear end of the bore. As a result, the outer conductor 36 makes contact with the conductive housing 18, the conductive pin 42 is shielded from contact with the housing by the insulating dielectric material cylindrical insert 47, and the probe 76 of the conductive pin extends down the central bore of the dielectric 47.

Figure 6:
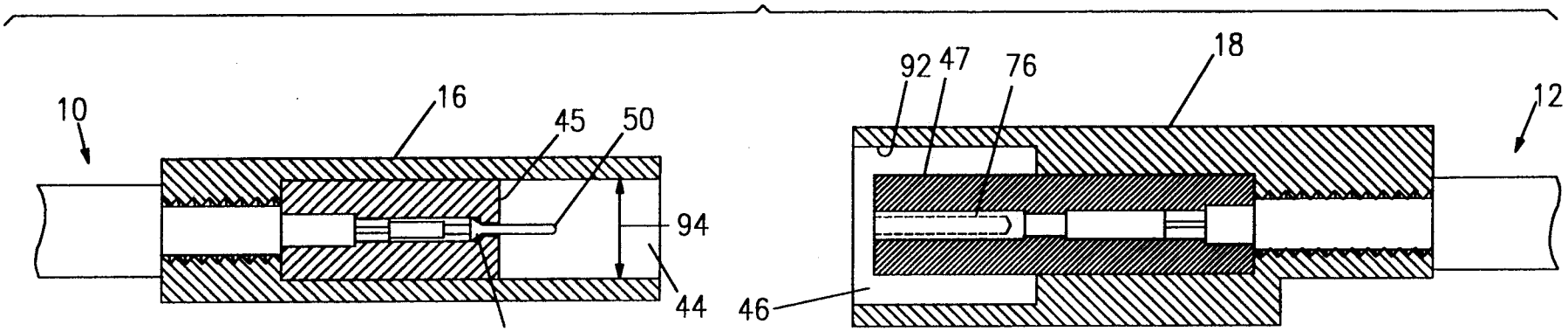
FIG. 6 is a cross-sectional view of the FIG. 3 male connector and the FIG. 5 female connector in position for engagement.

After the first cable 10 has been coupled to the male housing 16 and the second cable 12 has been coupled to the female housing 18, the two housings are ready to be connected together, as illustrated in FIG. 6. The outside dimension of the male housing 16 is slightly less than the inside dimension of section 92 of the female housing cylindrical bore 46. Similarly, the outside dimension of the female insulating cylinder 47 is slightly less than the inside dimension 94 of the male housing cylindrical bore 44. Thus, the male housing 16 can be inserted into the female housing 18 such that the male housing and female housing can be engaged together with a friction fit.

Figure 7:
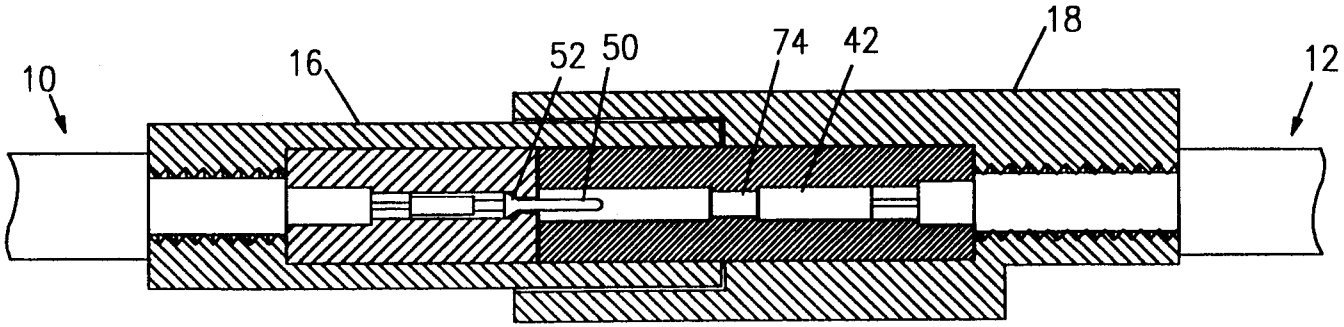
FIG. 7 is a cross-sectional view of the FIG. 6 connectors fully engaged.

FIGS. 6 and 7 show how the two housings are engaged and show that, when the male housing 16 is inserted into the female housing 18, the solid probe 50 simultaneously enters the hollow end 76 of the female conductive pin 42. The flared portion 52 of the male conductor pin 40 fits snugly within the insulating cylinder 45, providing a friction fit. The engagement of the two pins 40, 42 electrically couples the center conductor of the first cable 10 with the center conductor of the second cable 12, thus providing a continuous path for electrical signals.

Thus, an electrical connector in accordance with the invention provides a connector in which the outer conductors of one coaxial cable are simultaneously coupled to the outer conductors of another coaxial cable, while the center conductors of one cable are securely connected to the corresponding center conductor of another cable. The common connection of the outer conductors provides a low-noise, high quality ground for all of the outer conductors while a continuous but removable connection is provided for all of the center conductors.

While a description of a preferred coaxial cable connector assembly has been provided for the purpose of enabling a person of ordinary skill in the art to make and use the invention, it will be appreciated that the invention is not limited thereto. Accordingly, any modifications, variations, or equivalent arrangements within the scope of the attached claims should be considered to be within the scope of the invention.

What is claimed is:

1. An electrical connector assembly adapted to connect a first cable to a second cable, each cable including coaxial wires having a center conductor and an outer conductor separated by an insulating layer, by connecting the center and outer conductors of the first cable with the center and outer conductors, respectively, of the second cable, the electrical connector assembly comprising:

a male connector housing having a plurality of bores that are each adapted to receive a conductive pin;

a first plurality of conductive pins, each disposed within a different bore of the male connector housing and each being coupled to a different center conductor of the first coaxial cable;

a first plurality of dielectric material inserts, each disposed within a different male connector housing bore and insulating each respective first conductive pin from contact with the male connector housing bore;

a female connector housing having a plurality of bores that are each adapted to receive a conductive pin;

a second plurality of conductive pins, each disposed within a different bore of the female connector housing and each being coupled to different center conductor of the second coaxial cable; and a second plurality of dielectric material inserts, each disposed within a different female connector housing bore and insulating each respective second conductive pin from contact with the female connector housing bore;

wherein the male connector housing and first dielectric material inserts are adapted to engage with the female connector housing and second dielectric material inserts such that the second dielectric material inserts engage the male connector housing bore in a friction fit and the first conductive pins conductively engage the second conductive pins.

2. An electrical connector assembly according to claim 1, wherein the male connector housing and female connector housing are each constructed of an electrically conductive material.

3. An electrical connector assembly according to claim 1, wherein the mated electrical connector has a characteristic impedance approximately equal to that of a coaxial wire connected thereby.

* * * * *